US005377463A

United States Patent [19]

Howe

[11] Patent Number: 5,377,463

[45] Date of Patent: Jan. 3, 1995

[54] PANEL MOUNTING

[76] Inventor: Ian T. Howe, 19 Ryan Road, Pakenham, Victoria, 3810, Australia

[21] Appl. No.: 10,654

[22] Filed: Jan. 28, 1993

[30] Foreign Application Priority Data

Jan. 28, 1992 [AU] Australia ..... PL0600

[51] Int. Cl.[6] ..... E04B 2/82

[52] U.S. Cl. ..... 52/200; 52/94; 52/95; 52/389

[58] Field of Search ..... 52/94, 95, 389, 200

[56] References Cited

U.S. PATENT DOCUMENTS

| | | | |
|---|---|---|---|
| 3,344,566 | 10/1967 | Miles et al. | 52/94 |
| 4,109,428 | 8/1978 | Aarons | 52/95 |
| 4,227,352 | 10/1980 | Hallam | 52/94 |
| 4,339,898 | 7/1982 | Pichette | 52/94 |
| 4,744,612 | 5/1988 | Winter et al. . | |
| 4,819,390 | 4/1989 | Capper et al. | 52/95 |
| 5,058,300 | 10/1991 | Ernest et al. . | |
| 5,208,086 | 5/1993 | Owens | 52/389 |

FOREIGN PATENT DOCUMENTS

| | | |
|---|---|---|
| 8858982 | 3/1983 | Australia . |
| 0360465 | 3/1990 | European Pat. Off. . |
| 1587461 | 7/1977 | United Kingdom . |
| 8302636 | 8/1983 | WIPO . |
| 8503965 | 9/1985 | WIPO . |

OTHER PUBLICATIONS

GB Search Report dated Mar. 2, 1993.

*Primary Examiner*—Carl D. Friedman
*Assistant Examiner*—Wynn E. Wood
*Attorney, Agent, or Firm*—Trask, Britt & Rossa

[57] ABSTRACT

A mounting section (10) securable to a structure to enable mounting of a panel edge (21) to the structure. A base portion (16) is secured to the structure and a channel portion (11) receives the panel edge, the channel portion having a mouth (12) and two jaws (13, 14) defining the mouth and which are mounted to the base portion while the panel edge is being laterally moved into position. One jaw (13 or 57) is mounted to the base portion (16) by a hinged mounting (51, 52 or 58) enabling hinging movement during or subsequent to the location of the panel edge within the mouth. Retaining means (57 or 56) later retains the jaw against hinging movement. The retaining means forms a snap fit connection which is operable when the hinged jaw has been moved into its operative position confining the edge of the panel in the mouth of the channel portion. The retaining member is formed integrally with the hinged jaw with a flexible connecting portion between the retaining member and the hinged jaw. The wall defining the hinged jaw extends downwardly from the mouth to join the base portion and the retaining member extends from the mouth directly towards the base portion so that the base portion, retaining member and wall together define a triangular configuration in side sectional view. A key formation (63) comprising a plurality of projections (64) and concave formations (65) are provided on the base portion enabling a hardenable adhesive to secure the mounting section to the structure.

26 Claims, 7 Drawing Sheets

PANEL MOUNTING

This application is a continuation in part of the US national phase of PCT/AU91/00491 filed Oct. 25, 1991.

This invention relates to mounting of panels, particularly although not exclusively in the building and construction fields.

Figure 1:
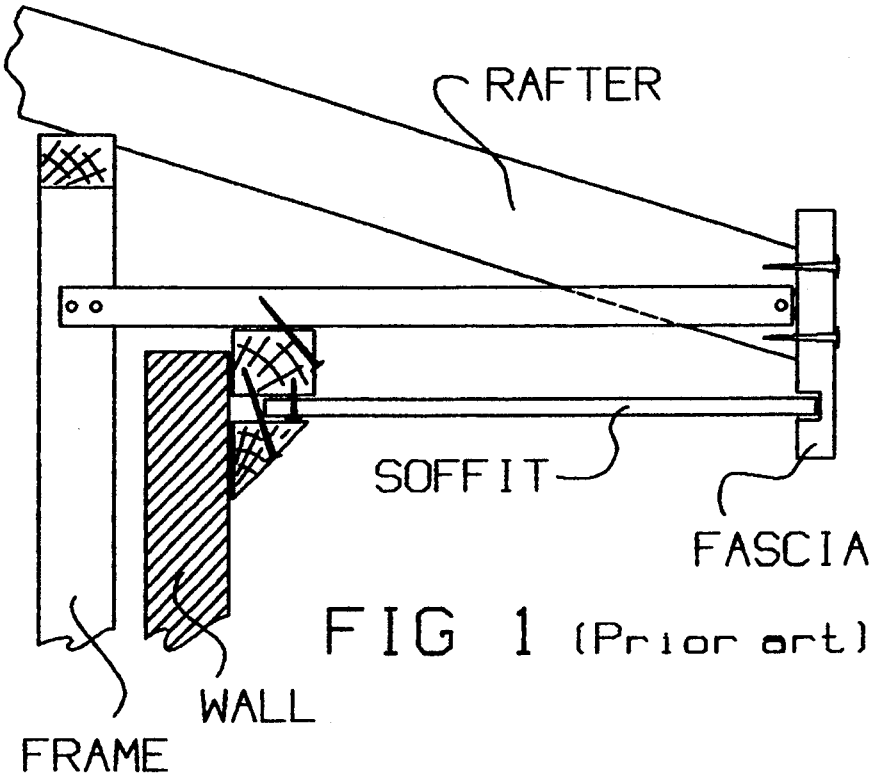
FIG 1 (Prior art)

In the building and construction industries, the mounting of panels to structural members is carried out in various ways. One particular technique used for mounting of a soffit beneath the saves of a building is particularly expensive in both materials and labour. The system commonly used for mounting of a soffit to extend between the fascia board and the wall of the building involves firstly mounting timber pieces to the projecting ends of the roof trusses so that these pieces extend downwardly generally adjacent to the building wall. A longitudinal beam is then fastened to the bottom ends of the downwardly extending pieces so as to be at the level of the groove normally provided along the inside face of the fascia board near the bottom edge. The soffit is then fitted into the groove in the fascia board and its inner edge adjacent to the building wall is nailed upwardly into the longitudinal beam. A concealing timber piece such as a triangular piece is then mounted beneath the inner edge of the soffit to conceal the fixing nails and also to finish the appearance, particularly since the soffit may not be cut with precision and may therefore not extend closely adjacent to the building wall along its length. This system of mounting a soffit is expensive both in the amount of materials required and also in the builder's labour required. This system is illustrated in FIG. 1 of the drawings.

It is an object of the present invention to provide a mounting section which enables relatively simple and effective mounting of a panel edge to an adjacent member within a structure or construction.

It is a preferred object to provide a mounting section which is particularly suitable for mounting of a soffit beneath the eaves of a building structure.

According to the present invention there is provided a mounting section for operative engagement with an edge of a panel, the mounting section been securable to a structure to thereby enable mounting of the panel edge to the structure, the mounting section including a channel portion for receiving the panel edge, the channel portion having a mouth through which the panel extends in use, the channel portion including a front wall at one side of the mouth and an opposed wall at the opposite side of the mouth, the panel edge being receivable between the front wall and the opposed wall, at least one of the front and opposed walls being resiliently movable away from the other wall to enable insertion of the panel edge into the mouth and for applying a biasing force to the panel edge towards the other wall so as to clamp the same, at least one of the front and opposed walls bearing against the panel edge along a line which is generally directly opposite to the contact of the other wall with the panel edge.

In one possible embodiment, the front wall is shorter than the opposed wall to allow the panel edge to enter the channel portion past the front wall by lateral movement of the panel edge so that the panel edge passes by the tip of the front wall and engages with the opposed wall to locate the panel edge at the mouth of the channel portion.

The front wall may be inclined inwardly towards the mouth of the channel portion so as to form a guide ramp for the panel edge which is engaged with the front wall and is moved laterally along the front wall towards the mouth of the channel portion.

Preferably, the opposed wall is inclined towards the front wall and towards the mouth of the channel portion and has a terminal lip for engagement with the panel edge, the panel edge in use engaging with the terminal lip and moving the opposed wall resiliently away from its rest condition to open the mouth of the channel portion and enable insertion of the panel edge into the mouth.

A biasing means may be located internally of the channel portion, the biasing means being arranged to engage with the panel edge when received within the mouth and to apply a biasing force to the panel edge in a direction out of the channel portion. The biasing means comprises a biasing tongue arranged within the channel portion and located so as to be engaged by the panel edge and resiliently urged thereby away from the mouth so that the tongue applies the outward force to the panel edge in reaction to the inwardly directed force of the panel edge. The biasing tongue is preferably secured to the channel portion at or in the vicinity of the region at the base of the opposed wall remote from the channel mouth, the arrangement being such that when the opposed wall is resiliently moved away from its rest position as a result of engagement by the panel edge, the biasing tongue is located inwardly of the mouth of the channel portion and engages with the panel edge when it enters the mouth.

In one possible embodiment, the front wall is movable, the front wall having a rest position and being movable from its rest position inwardly of the channel portion to allow the panel edge to enter the mouth of the channel portion past the movable wall by lateral movement of the panel edge, the front wall being returned towards its rest position when the panel edge has passed the movable wall and entered the channel portion between the front and opposed walls. The front wall may be movable by a hinging movement about its edge remote from the mouth so as to be movable towards the base wall of the channel portion during the movement of a panel edge past the front wall. The front wall is preferably resiliently movable so that when the panel edge moves past the tip of the movable front wall at the mouth, the front wall will resiliently move back towards its rest position and enable the panel edge to be located and clamped between the front and opposed walls.

The channel portion may comprise a base portion and a movable front wall and opposed wall are formed integrally, the channel portion further including a mounting flange forming a continuation of the general plane of the base portion and enabling mounting of the channel portion to the structure.

The channel portion may comprise a base portion for mounting to the structure, the opposed wall being attached to the base portion and being resiliently movable upon contact of the panel edge therewith, the front wall comprising a separate member which is mountable to the base portion after the panel edge is moved into its generally desired position and bears against the opposed wall so as to locate and clamp the panel edge between the opposed wall and the front wall.

The front wall in one embodiment may be defined by a separate member, the separate member having a main wall which defines the front wall, the main wall extending in use to the panel edge from the base portion and bearing against the panel edge, the separate member further comprising a retaining web extending from the main wall towards the base portion and being connected in use to the base portion to retain the separate member to the base portion. In this embodiment, the main web may be fitted to the base portion so as to be capable of hinging movement relative to the base portion and thereby move into engagement with the panel edge when it is located against the opposed wall and to bring the retaining web into engagement with the base portion for connection thereto. The retaining web may be connected to the base with a snap fit between complementary formations provided by the retaining web and the base portion.

According to the present invention there is also provided a mounting section for operative engagement with an edge of a panel, the mounting section being securable to a structure to thereby enable mounting of the panel edge to the structure, the mounting section including a base portion for securing to the structure and a channel portion for receiving the panel edge, the channel portion having a mouth facing away from the base portion and through which the panel extends in use, the channel portion including a first jaw defining one side of the mouth and an opposed second jaw defining the opposite side of the mouth, both the first and second jaws being mounted to the base portion while the panel edge is being located in the general position in which it will mounted by the mounting section to the structure, the second jaw being mounted to the base portion by a hinged mounting enabling hinging movement of the second jaw relative to the base during or subsequent to the location of the panel edge within the mouth of the channel portion, the mounting section further including retaining means operable between the second jaw and the base portion so as to retain the second jaw against hinging movement following location of the panel edge within the mouth of the channel portion.

Preferably the second jaw can adopt an initial position allowing the panel edge to enter the mouth, the mouth being larger than the thickness of the edge of the panel member when the second jaw is in its initial position, the second jaw then being movable inwardly towards the first jaw about its hinged mounting so as to close the width of the mouth in the channel portion.

The second jaw in its initial position is preferably nearer to the structure than the first jaw whereby the panel edge can move laterally into the channel portion past the second jaw and into engagement with the first jaw, the second jaw thereafter being movable by hinging movement about its hinged mounting outwardly and away from the structure so as to confine the edge of the panel within the mouth defined between the first and second jaw.

The retaining means which is operable between the second jaw and the base portion preferably forms a snap fit connection which is operable when the second jaw has been moved into its operative position confining the edge of the panel in the mouth of the channel portion. The retaining member may be connected to the second jaw at a position on the second jaw spaced outwardly in relation to the hinged mounting of the second jaw to the base portion, the retaining member forming a snap fit connection to the base portion when the second jaw is moved into its operative position. In this embodiment, the snap fit connection may comprise cooperating male and female formations, at least one of the said male and female formations being resilient to enable the snap fit connection thereof and to enable selective release of the snap fit connection. The retaining member may be connected to the second jaw at a hinge which enables the retaining member to be moved with a hinging movement about that hinge during assembly of the edge of the panel with the mounting section. Preferably the retaining member is formed integrally with said second jaw and said hinge is defined by a flexible connecting portion between the retaining member and the second jaw.

The second jaw may comprise a wall having an outer edge defining together with the first jaw the mouth of the channel portion having an inner edge, the hinged mounting of the second jaw being located along the inner edge of the wall where the wall is mounted to the base portion. The wall may extend downwardly from the mouth to join the base portion and the retaining member may extend from the mouth directly towards the base portion so that the base portion, retaining member and wall together define a triangular configuration in side sectional view. The retaining member may connect to the base portion by a hinge connection, the retaining member may connect to the wall by a hinge connection, and the wall may connect to the base portion by a snap fit connection after the panel is located in its generally desired final position and extends through the mouth.

The mounting section may further include a key formation enabling securing of the base portion to the structure by securing means which cooperates with the key formation and with the structure to secure the base portion to the structure. The key formation preferably comprises a plurality of projections and concave formations provided on the base portion and facing generally towards the structure, the securing means comprising a hardenable adhesive which is located between the mounting section and the structure and which in use conforms to the shape of the projections and concave formations and which adheres to the structure so that when the adhesive has hardened it secures the mounting section to the structure.

According to a third aspect of the invention there is provided a mounting section for operative engagement with an edge of a panel, the mounting section being securable to a structure to thereby enable mounting of the panel edge to the structure, the mounting section including a base portion for securing to the structure and a channel portion for receiving the panel edge, the channel portion having a mouth facing away from the base portion and through which the panel extends in use, the channel portion including a first jaw defining one side of the mouth and an opposed second jaw defining the opposite side of the mouth, both the first and second jaws being mounted to the base portion when the panel edge is located in the general position in which it is mounted by the mounting section to the structure, the mounting section further including a key formation enabling securing of the base portion to the structure by securing means which cooperates with the key formation and with the structure to secure the base portion to the structure.

Preferably the mounting section comprises an elongated section of generally constant cross-sectional shape so that the mounting section mounts the panel edge along a substantial length of the panel.

Figure 2:
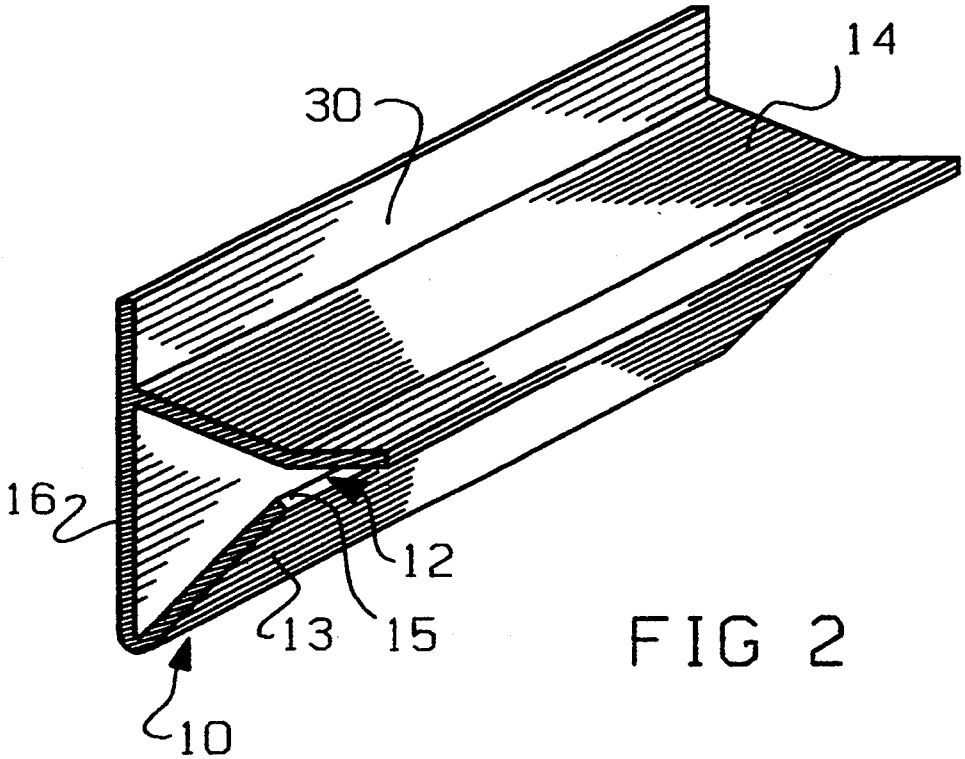
Figure 3:
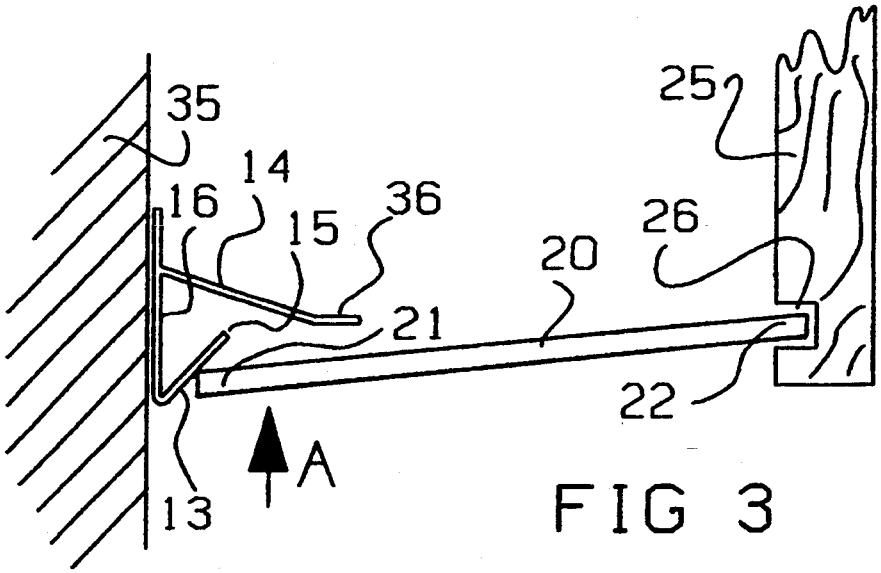
Figure 4:
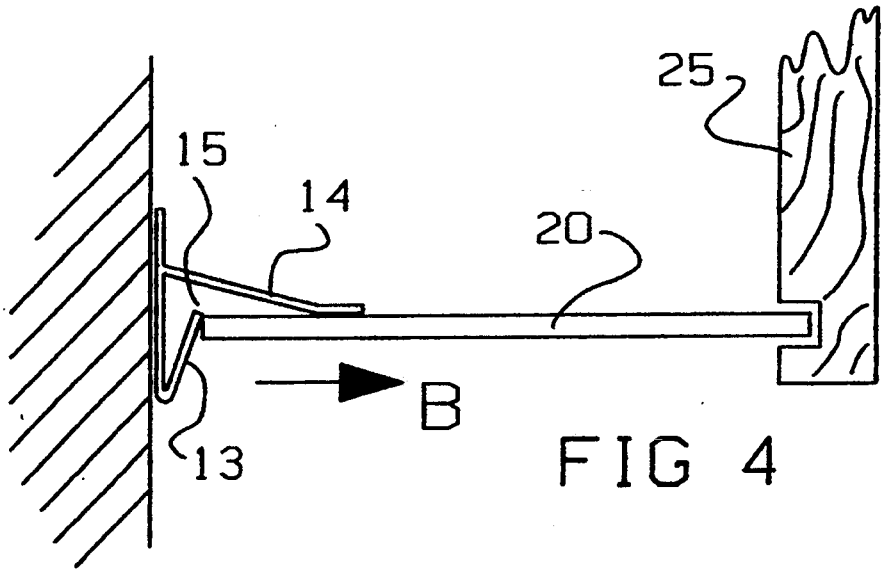
Figure 5:
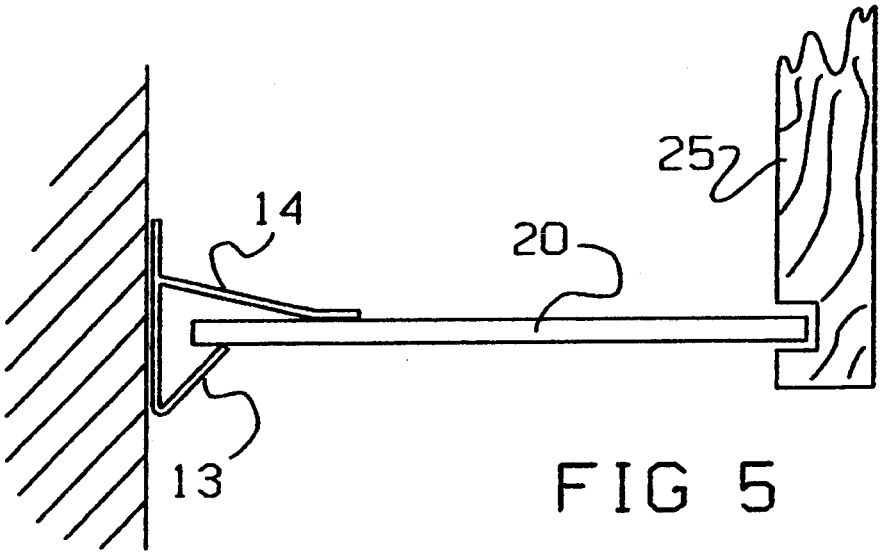
Figure 7:
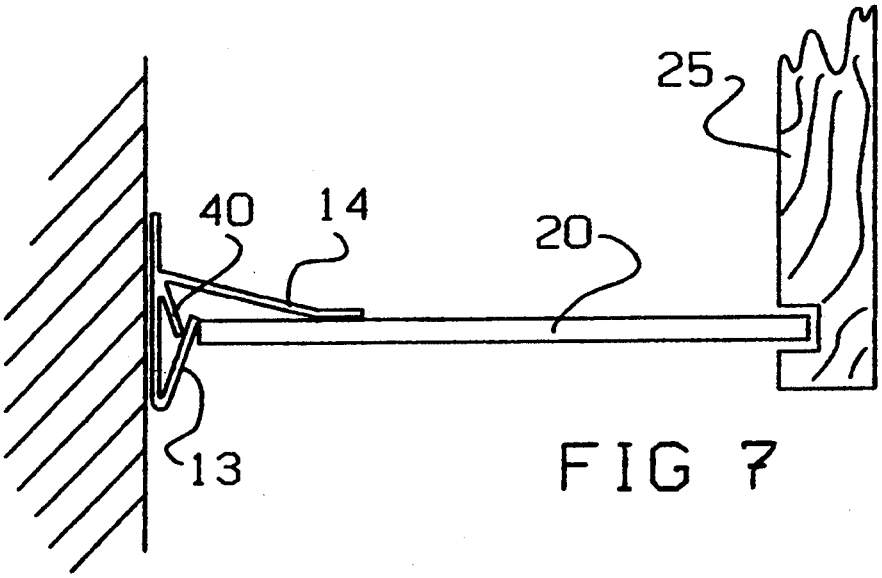
Figure 8:
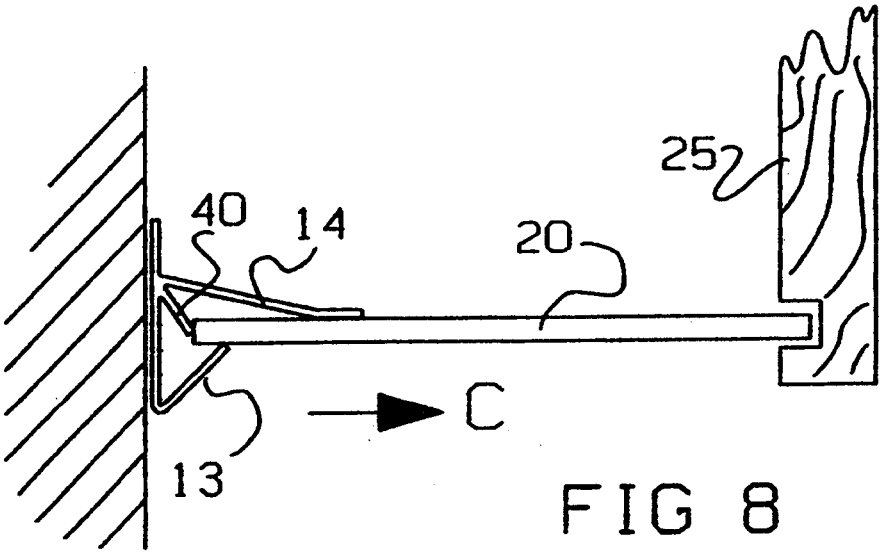
Figure 10:
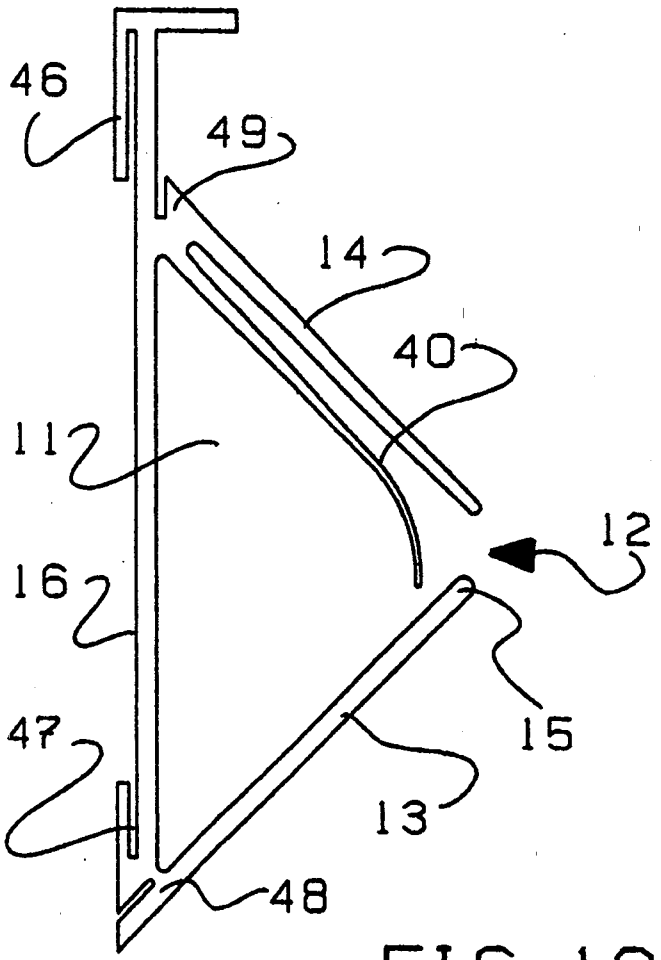
Figure 9:
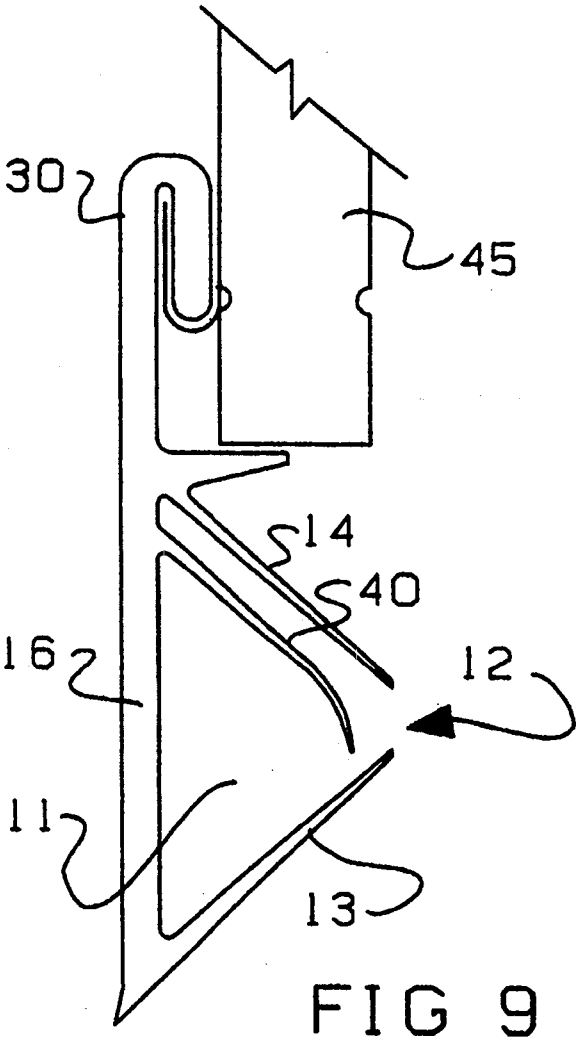
Figure 11:
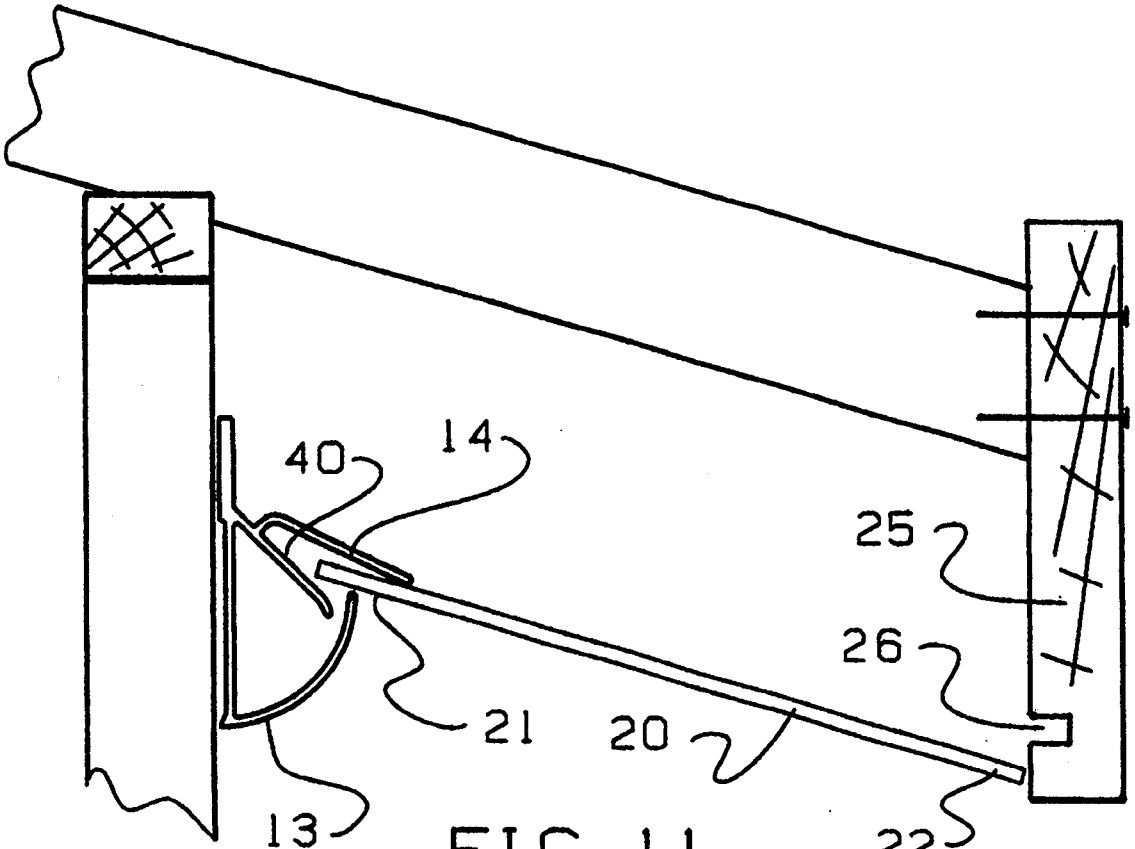
Figure 15:
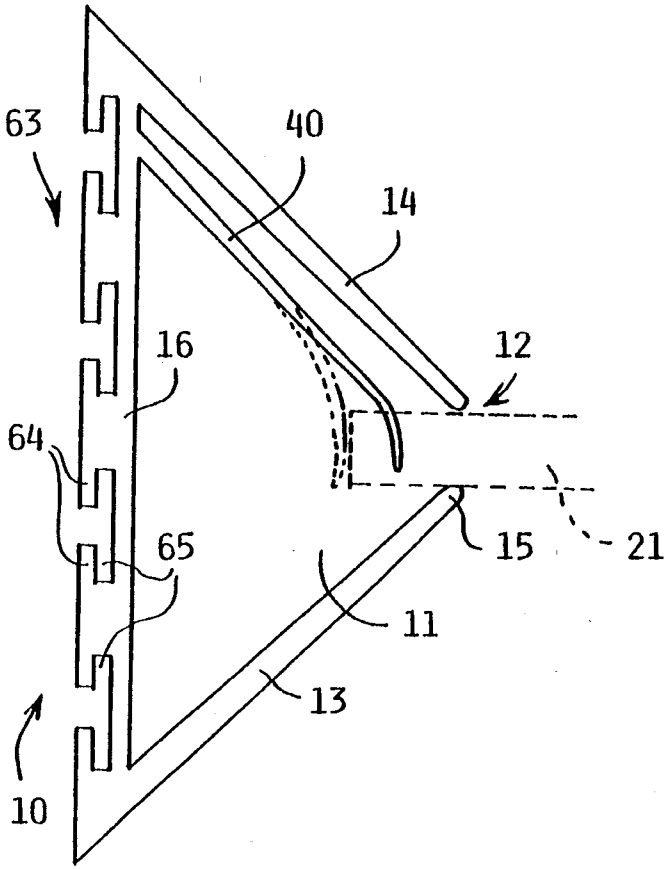
Figure 12:
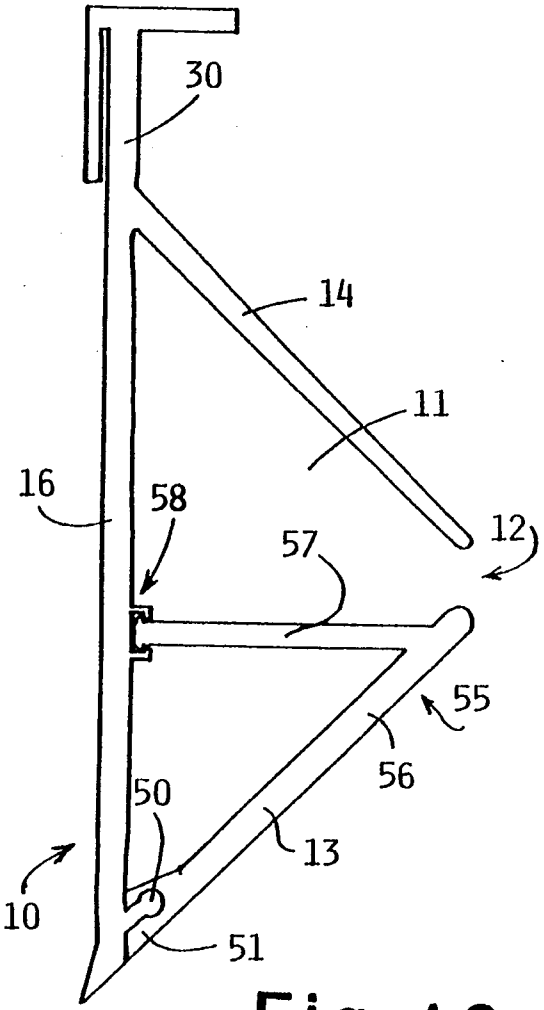
Figure 14:
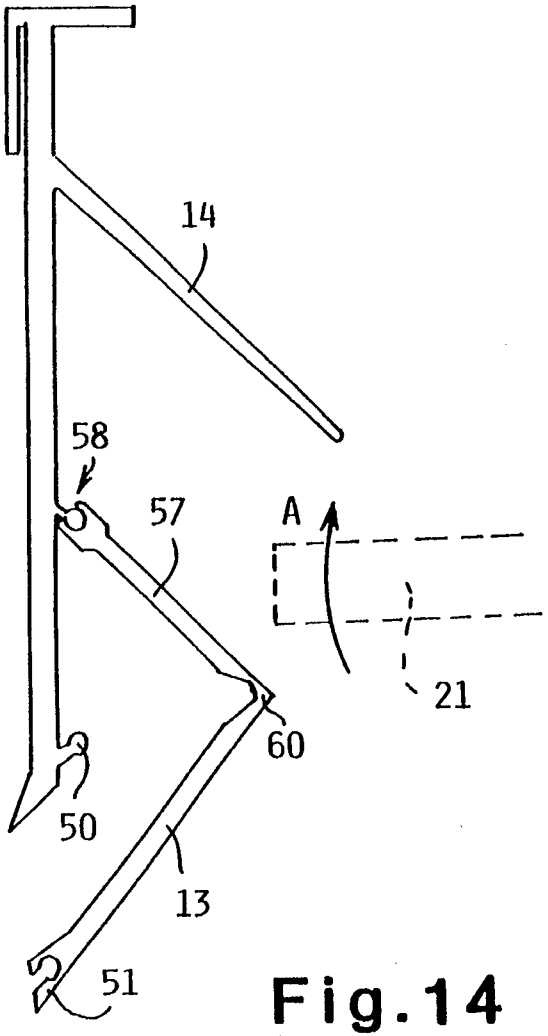
Figure 13:
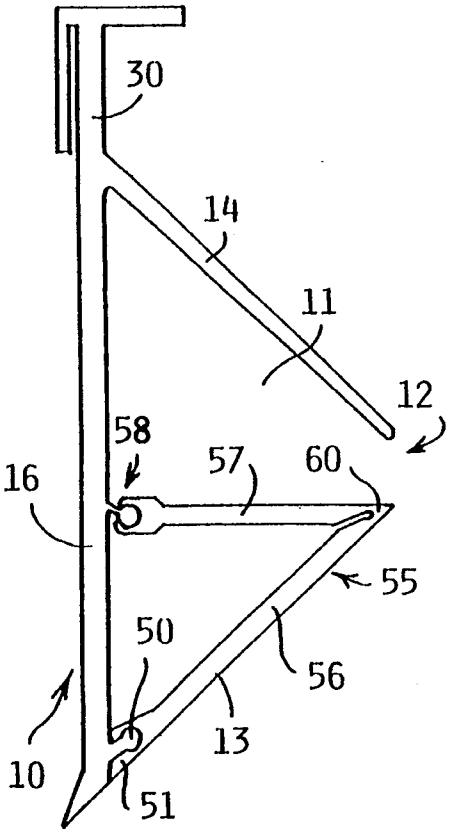

Possible and preferred features of the present invention will now be described with particular reference to the accompanying drawings. However it is to be understood that the features illustrated in and described with reference to the drawings are not to be construed as limiting on the scope of the invention. In the drawings:

FIG. 1 shows a cross-sectional view through the eave assembly of a building structure using the system of fixing the soffit used in the prior art, FIG. 2 is a perspective view of a length of mounting section according to a possible embodiment of the present invention, FIGS. 3 to 5 show the sequence of operations in mounting of a panel edge using the mounting section of FIG. 2, FIGS. 6 to 8 show respective steps in the mounting of a panel edge using a mounting section according to a second possible embodiment of the present invention, FIGS. 9, 10 and 11 illustrate further possible embodiments of mounting sections according to the invention, FIGS. 12 and 13 show cross-sectional views of mounting sections according to two further possible embodiments of the present invention, FIG. 14 shows the operations in mounting of a panel edge using the mounting section of FIG. 13, and FIG. 15 shows a mounting section having a key formation.

FIG. 1 shows a known system of mounting a soffit which is outlined in the introductory part of this specification.

In FIG. 2 there is shown a mounting section 10 having an elongated form of constant cross-section e.g. an extrusion or folded or roll-formed section. This section 10 may be made of a suitable plastics material or metal, preferably having resilient properties and being of durable material. The section includes a channel portion 11 having a mouth 12, the mouth being defined between a lower movable front wall 13 and an upper opposed wall 14. The movable wall 13 is shown in FIG. 2 in its rest position. The movable wall 13 is shorter than the opposed wall 14 to allow a panel edge 21 such as a soffit to pass by the tip 15 of the movable wall 13 but engage with the opposed wall 14 as shown in the sequence of operations illustrated in FIGS. 3 to 5. The movable front wall 13 inclines inwardly, e.g. at about 45°, to the base web 16 of the channel portion 11, so as to form a guide ramp for the panel edge 21 which engages with the movable wall 13 and moves upwardly as shown in FIG. 4 by arrow A into the channel portion 11. During this movement, the movable wall 13 resiliently moves inwardly towards the base web 16 allowing the panel edge 21 to pass. Simultaneously with this movement, the resilience of the movable wall 13 will cause a force to be applied in the direction of arrow B (FIG. 4) through the panel 20 so as to press the remote panel edge 22 into the groove 26 in the fascia 25. To retain the remote panel edge 22 in the groove 26, there may be suitable adhesive deposited within the groove 26 immediately prior to the assembly of the panel 20 into position. When the panel edge 21 passes the tip 15 of the movable wall 13, the movable wall 13 will spring back towards its rest position and will adopt the supporting position for the panel edge 21 shown in FIG. 5. It will be seen that the movable wall 13 also provides a finished aesthetically satisfactory result similar to the triangular bead used in the prior art shown in FIG. 1.

The movable wall 13, base web 16 and opposed wall 14 of the channel portion 11 are formed integrally, e.g. by extrusion of the mounting section. The channel portion 11 is provided with a mounting flange 30 shown in FIG. 2 as forming a continuation of the plane of the base web 16 and extending upwardly beyond the opposed wall 14. This web 30 can enable fastening means such as adhesive to be applied to secure the section to the adjacent structure 35. Alternatively, fasteners such as nails or screws can be passed through the flange 30 into the structure 35 to which the panel 20 is to be mounted.

The opposed wall 14 is shown as being inclined slightly towards the movable wall 13 and having a terminal lip 36 which engages with the panel edge 21. The opposed wall 14, being made of the same material as the movable wall 13, is resilient and as shown in FIGS. 4 and 5 will resiliently move away from its initial rest position shown in FIGS. 2 and 3 when the panel edge 21 is pushed against it past the tip 15 of the movable wall 13. This resilient movement of the opposed wall 14 enables a clamping effect to be achieved at the panel edge 21 to assist in stable support of the panel edge. As shown in the drawings, the width of the mouth 12 between the tip 15 of the movable wall 13 and the opposed wall 14 is slightly smaller than the thickness of the panel edge 21 so as to promote clamping of the panel edge 21 as a result of the resilience of the two facing walls 13, 14.

Figure 6:
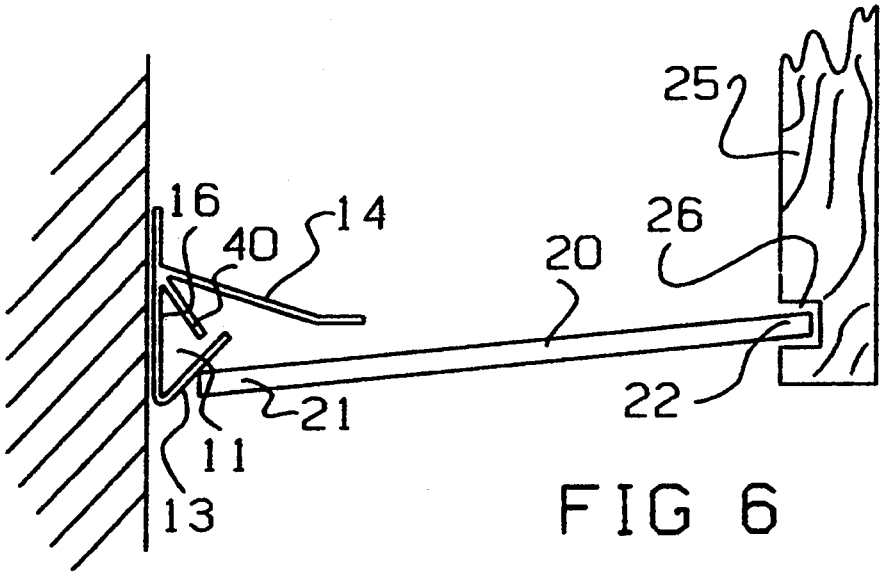

In the modified embodiment shown in FIGS. 6 to 8, the movable wall 13 is generally similar to the embodiment described above. However, the channel portion 11 further includes a biasing tongue 40 located internally of the channel portion 11. The biasing tongue 40 is operative to engage with the panel edge 21 to apply a biasing force to that edge 21 in a direction out of the channel portion 11. This biasing force can therefore assist in engagement of the remote panel edge 22 with a structural member 25 at that remote edge. In particular, the biasing tongue 40 in the drawings can apply a biasing force in the direction of arrow C in FIG. 8 to press a panel 20, e.g. a soffit into the groove 26 in the fascia 25. The biasing tongue 40 is integral with the opposed wall 14 and is located adjacent to the base of the opposed wall 14 where it is connected to the base web 16. When the opposed wall 14 is resiliently moved upwardly from the position shown in FIG. 6 as a result of engagement by the panel edge 21 as shown in FIG. 7, the biasing tongue 40 will move outwardly away from the base web 16 as shown in FIG. 8 and apply a biasing force to the panel edge 21 in the direction of arrow C to urge the remote panel edge 22 into engagement with fascia 25.

In FIG. 9 there is shown an alternative possible mounting section 10 having a flange 30 which projects upwardly from the base web 16 and is turned downwardly to enable mounting to a suspended structural portion 45. Located within the channel portion 11 is a biasing tongue 40 which projects outwardly from the base web 16 towards the mouth 12. When a panel edge is received between the front wall and opposed wall 14 through the mouth 12, the panel edge engages with the biasing tongue 40 so that the tongue is urged resiliently towards the base web 16 thereby applying in reaction of force to the panel edge.

In FIG. 10 there is shown a further embodiment of a mounting section having a biasing tongue 40 similar to the arrangement shown in FIG. 9. In FIG. 10, the rear face of the base web 16 is provided with cantilevered webs 46, 47 facing each other so that a reinforcing member can be located and retained against the rear face of the web 16. The webs 46, 47 also enable the mounting section to be mounted to a structural member by a complementary member mounted to the structure and which forms a close fit within the webs 46 and 47. Also in FIG. 10, the front wall 13 is provided with a weakened area 48 at its base where it connects to the base web 16 so that that wall 13 is capable of hinging movement about the weakened area 48 during insertion of the panel edge past the tip 15 of the front wall 13 and into the mouth 12 of the channel portion 11. During such hinging movement of the front wall 13, the tip 15 engages with the biasing tongue 40 and urges the tongue towards the base web 16. The opposed wall 14 is also provided with a weakened area 49 at its base where it connects to the base web 16 so that the opposed wall 14 can resiliently move upwardly when the panel edge is pushed past the tip 15 and bears against the opposed web 14. When the opposed web 14 has moved upwardly to a sufficient extent and the panel edge moves past the tip 15, the front wall 13 resiliently moves back to its rest position shown in FIG. 10 and the biasing tongue 40 presses outwardly against the panel edge. The panel edge is also clamped between the edges of the front wall 13 and opposed wall 14.

FIG. 11 shows a further embodiment of a mounting section in which the front wall 13 is arcuate in section so as to resemble a length of quad when viewed from beneath. As shown in FIG. 11, this mounting section may be utilised by inserting the panel edge 21 into the mouth, hinging the far end 22 of the panel 20 upwardly, at the same time the end 21 bearing against and urging inwardly the biasing tongue 40. When the remote edge 22 has been raised so as to be aligned with the groove 26 in the structural member 25, the biasing tongue 40 will urge the end 22 into the groove 26. The panel edge 21 will be supported by the front wall 13 which also forms an aesthetically satisfactory finish.

In FIGS. 12 and 13 there are shown two part mounting sections. In FIG. 12 the main section comprises base web 16 and opposed wall 14. The opposed wall 14 is resiliently movable upon contact by a panel edge from beneath. The front wall 13 comprises a separate member 55 which is mountable to the base web 16 after the panel edge has been moved into its generally desired position and bears upwardly against the opposed wall 14. The front wall 13 is fitted to the lower edge of the base web 16 by complementary male and female formations 50, 51 which permit at least limited pivoting movement of the front wall 13. The separate member 55 has a main wall 56 which defines the front wall 13 so that the main wall extends in use from the bottom edge of the base web 16 to the mouth 11 and to thereby contact and support the panel edge. The separate member 55 also includes a retaining web 57 which extends from the main wall 56 towards the base web 16 and is connected to the base web 16 after location of the panel edge in position so as to thereby retain the member 55 to the base web 16. The hinging movement of the front wall 13 about the connection 50, 51 enables the member 55 to be hinged upwardly into contact with the panel edge. The retaining web 57 is connected to the base web 16 with a snap fit between complementary formations 58 provided by the retaining web 57 and the base web 16. The resilient downward force applied by the opposed wall 14 clamps the panel edge.

The panel mounting section in FIG. 12 could also be made in one piece with the main wall 56 integral with the base web 16. A weakened portion at the base of the main wall 56 where it joins the base web 16, or located a short distance up the base web, can enable pivoting of the main wall 56. The integral retaining web 57 can initially be spaced from the base web 16 and when the main wall 56 is hinged upwardly after the panel edge is in position, the complementary formations 58 engage to retain the main wall 56 in position as shown in FIG. 12.

The panel mounting section in FIG. 13 is generally similar to the section in FIG. 12 and the same reference numerals have been used. However, in FIG. 13, the formations 58 are complementary male and female formations similar to the formations 50, 51 at the lower connection. With this arrangement, the formations 58 can enable pivoting movement of the web 57 about the base web 16 as shown in FIG. 14 to allow the panel edge 21 to laterally pass into the mouth 12. Subsequently the connection 50, 51 connects the main wall 56 to the base web 16 to secure the wall 13 and web 57 in final position.

Also the section shown in FIG. 13 includes a weakened area at the elbow 60 between the front wall 13 and the web 57 so as to provide a hinging line during the assembly of the panel edge with the mounting section. In particular, the connection 50, 51 can be assembled while the formations 58 are disassembled and the front wall 13 and web 57 can be hinged about the elbow region 60 to enable the panel edge to be located in position, the front wall 13 to be then hinged upwardly to contact the panel edge at the region 60 and the formations 58 then being connected with a snap fit. Alternatively, as shown in FIG. 14, a hinge connection can be provided at 58 with the connection 50, 51 not yet assembled and the web 57 can be pivoted downwardly away from the opposed wall 14 and the front wall 13 can be hinged away from the web 57 about the elbow region 60. The panel edge 21 can then be located in position by lateral movement in the direction of arrow A and the web 57 pivoted upwardly so that engagement with the panel edge occurs at the region 60, the connection 50, 51 then being completed with a snap fit.

In FIG. 15, the base web 16 is provided with a key formation 63 provided at intervals or extending along the web 16 and which is shown as a number of projections 64 which define concave formations 65. In use of this section, adhesive can be placed along the web 16 and the adhesive will enter the concave formations 65. The mounting section can then be located in position against the structure, e.g. a masonary wall, so that the adhesive also contacts the structure. When the adhesive has set, the mounting section will be firmly secured to the structure because the adhesive that has entered the concave formations 65 will mechanically retain the section in position. The provision of the key formation 63 therefore enables a plastics or other material extrusion to be used without oil or other contamination of the surface of the extrusion interfering with or weakening the bond that an adhesive material might make with the mounting section. Such a key formation can be provided on the base portions 16 of the sections shown in other Figs. if desired.

It will be seen that the mounting sections illustrated and described with reference to the accompanying drawings will enable relatively simple and effective mounting of a panel edge to a structure. In particular, a mounting section can be readily mounted to a structure by adhesive or by fastenings, e.g. applied through the projecting flange 30 into the structure. In most embodiments, a panel edge 21 can be moved laterally past the tip 15 or elbow 60 of the movable front wall 13 which resiliently moves inwardly to allow the panel edge 21 to pass. The panel edge engages the opposed wall 14 and resiliently moves it away from its rest position. The movable front wall 13 springs back to its initial rest position when the panel edge 21 has passed the tip 15. The panel edge 21 can then be held within the channel portion 11 with a clamping force applied by the front and opposed walls 13, 14. In FIGS. 12 to 14, the panel edge 21 pushes opposed wall 14 upwardly enabling front wall 13 to be connected and the panel edge to be clamped. The assembly operation is particularly simple and effective and the resulting structure can be aesthetically satisfactory. Because the panel edge 21 is concealed within the channel portion 11, the width of the panel 20 need not be precisely measured and need not be a perfect straight line.

In one possible variation of the embodiments shown in FIGS. 13 to 14, the retaining web 57 may be integral with the base web 16 so that there is an integral hinge connection 58, and an integral hinge at elbow 60, and a snap fit connection 50, 51 generally as shown in FIG. 14. This integral construction of the mounting section may be achieved by forming the hinges at 58 and 60 of a flexible plastics materials, the remainder of the mounting section being composed of a stiff but resilient plastics material. Such a construction can be produced by co-extrusion of the two plastics materials.

It is to be appreciated that the mounting section can be used in other situations where a panel edge is to be mounted to a structure. For example, the panel may be a vertical panel being joined to a vertical post or wall.

Modifications may be made to the panel mounting system according to the present invention without departing from the scope of the present invention. For example, although a constant cross-section elongated mounting section is preferred, the mounting section may relatively short and may be used as fastener clips at spaced points along the panel edge.

The section may be mounted inside a frame so as to be partially concealed, leaving the tip region of the movable front wall exposed for contact by the panel edge.

Adjacent pieces of the mounting section may be neatly joined together by means of short cover pieces or joining pieces of complementary shape. The joining pieces may comprise, for example, generally V-shaped pieces having one wall arranged to fit between the outside face of the base web and the adjacent structural wall and having the other wall extending up the outside of the movable front walls of the adjacent mounting sections so as to cover the join line. Also at corners, the mounting sections may be mitred for providing an aesthetically satisfactory finish. The mitred ends of adjacent mounting sections may also be covered by a corner cover piece of suitable shape.

The panel mounting may be attached to a structure by suspending it from above, rather than by fixing it to a wall. For example, timber droppers or equivalent metal strip hangers similar to those used in the prior system may be used as mountings for the mounting section.

Although particularly described for mounting of a soffit, the panel mounting may be useful for mounting of other types of panels. For example, the mounting section according to the invention may be used for mounting of a glass panel or pane within a frame. In this case, the mounting section would be provided along one edge and the opposite edge of the panel could engage in a groove or the like provided along the opposite side of the frame.

It is to be understood that various alterations, modifications and/or additions may be made to the features of the possible and preferred embodiment(s) of the invention as herein described without departing from the scope of the invention as defined in the following claims.

I claim:

1. An elongated mounting section for operative engagement with an edge of a panel, the panel having a plane, the mounting section being securable to a structure to thereby enable mounting of the panel edge to the structure, the mounting section including a channel portion extending in a longitudinal direction and for receiving the panel edge, the channel portion having a mouth through which the panel extends in use, the channel portion including a front wall extending continuously in the longitudinal direction and for the length of the mounting section, the front wall defining one side of the mouth and an opposed wall extending in the longitudinal direction and defining an opposite side of the mouth, the front wall and opposed wall being connected together and the panel edge being receivable between the front wall and the opposed wall, one of the front wall and opposed wall being resiliently movable away from the other wall, the front wall being resiliently movable inwardly of the channel portion, the panel edge being receivable in the mouth by movement of the panel edge in a lateral direction which is transverse to both the plane of the panel and to the longitudinal direction so that the panel edge moves past the front wall while the front wall is resiliently moved inwardly of the channel portion, and while the panel edge moves generally directly towards the opposed wall and into its generally desired final position, whereafter the front wall past which the panel edge has moved resiliently returns to its operative position in which the wall which is resiliently movable away from the other wall applies a biasing force to the panel edge so as to clamp the same.

2. A mounting section for operative engagement with an edge of a panel, the mounting section being securable to a structure to thereby enable mounting of the panel edge to the structure, the mounting section including a channel portion for receiving the panel edge, the channel portion having a mouth through which the panel extends in use, the channel portion including a base portion for mounting to the structure, a front wall defining one side of the mouth and an opposed wall defining an opposite side of the mouth, the front wall and opposed wall being connected together when the panel edge is received between the front wall and the opposed wall, the opposed wall being attached to the base portion and being resiliently movable upon contact of the panel edge therewith, the front wall comprising a separate member which is mountable to the base portion after the panel edge is moved into its generally desired position in which it is bearing against the opposed wall so that the panel edge is located and clamped between the resiliently movable opposed wall and the front wall, the separate member having a main wall which defines the front wall, the main wall extending in use to the panel edge from the base portion and bearing against the panel edge, the separate member further comprising a retaining web extending from the main wall towards the base portion and being connected in use to the base portion to retain the separate member to the base portion.

3. A mounting section as claimed in claim 1 wherein the front wall is shorter than the opposed wall to allow the panel edge to enter the channel portion past the front wall by lateral movement of the panel edge so that the panel edge passes by the tip of the front wall and engages with the opposed wall to locate the panel edge at the mouth of the channel portion.

4. A mounting section as claimed in claim 1 wherein the front wall is inclined inwardly towards the mouth of the channel portion so as to form a guide ramp for the panel edge which is engaged with the front wall and is moved laterally along the front wall towards the mouth of the channel portion.

5. A mounting section as claimed in claim 1 wherein the opposed wall is inclined towards the front wall and towards the mouth of the channel portion and has a terminal lip for engagement with the panel edge, the panel edge in use engaging with the terminal lip and moving the opposed wall resiliently away from its rest condition to open the mouth of the channel portion and enable insertion of the panel edge into the mouth.

6. A mounting section as claimed in claim 1 and further including a biasing means located internally of the channel portion, the biasing means being arranged to engage with the panel edge when received within the mouth and to apply a biasing force to the panel edge in a direction out of the channel portion.

7. A mounting section as claimed in claim 6 wherein the biasing means comprises a biasing tongue arranged within the channel portion and located so as to be engaged by the panel edge and resiliently urged thereby away from the mouth so that the tongue applies the outward force to the panel edge in reaction to the inwardly directed force of the panel edge.

8. A mounting section as claimed in claim 7 wherein the biasing tongue is secured to the channel portion at or in the vicinity of the region at the base of the opposed wall remote from the channel mouth, the arrangement being such that when the opposed wall is resiliently moved away from its rest position as a result of engagement by the panel edge, the biasing tongue is located inwardly of the mouth of the channel portion and engages with the panel edge when it enters the mouth.

9. A mounting section as claimed in claim 1 wherein the channel portion comprising a base portion and the movable front wall and opposed wall are formed integrally, the channel portion further including a mounting flange forming a continuation of the general plane of the base portion and enabling mounting of the channel portion to the structure.

10. A mounting section as claimed in claim 2 wherein the main wall is fitted to the base portion so as to be capable of hinging movement relative to the base portion and thereby move into engagement with the panel edge when it is located against the opposed wall and to bring the retaining web into engagement with the base portion for connection thereto.

11. A mounting section as claimed in claim 2 wherein the retaining web is connected to the base with a snap fit between complementary formations provided by the retaining web and the base portion.

12. A mounting section as claimed in claim 1 and further including a base portion, the front and opposed walls being both connected to the base portion and said front wall is connected to said base portion at a hinge connection to enable the front wall to hinge about its connection to the base portion after location of the panel edge in its generally desired final position.

13. A mounting section for operative engagement with an edge of a panel, the mounting section being securable to a structure to thereby enable mounting of the panel edge to the structure, the mounting section including a base portion for securing to the structure and a channel portion for receiving the panel edge, the channel portion having a mouth facing away from the base portion and through which the panel extends in use, the channel portion including a first jaw defining one side of the mouth and an opposed second jaw defining the opposite side of the mouth, both the first and second jaws being mounted to the base portion while the panel edge is being located in the general position in which it will be mounted by the mounting section to the structure, the second jaw being mounted to the base portion by a hinged mounting enabling hinging movement of the second jaw relative to the base during or subsequent to the location of the panel edge within the mouth of the channel portion, the mounting section further including retaining means operable between the second jaw and the base portion so as to retain the second jaw against hinging movement following location of the panel edge within the mouth of the channel portion.

14. A mounting section as claimed in claim 13 wherein the second jaw can adopt an initial position allowing the panel edge to enter the mouth, the mouth being larger than the thickness of the edge of the panel member when the second jaw is in its initial position, the second jaw then being movable inwardly towards the first jaw about its hinged mounting so as to close the width of the mouth in the channel portion.

15. A mounting section as claimed in claim 14 wherein the second jaw in its initial position is nearer to the structure than the first jaw whereby the panel edge can move laterally into the channel portion past the second jaw and into engagement with the first jaw, the second jaw thereafter being movable by hinging movement about its hinged mounting outwardly and away from the structure so as to confine the edge of the panel within the mouth defined between the first and second jaw.

16. A mounting section as claimed in claim 13 wherein the retaining means which is operable between the second jaw and the base portion forms a snap fit connection which is operable when the second jaw has been moved into its operative position confining the edge of the panel in the mouth of the channel portion.

17. A mounting section as claimed in claim 16 wherein the retaining member is connected to the second jaw at a position on the second jaw spaced outwardly in relation to the hinged mounting of the second jaw to the base portion, the retaining member forming a snap fit connection to the base portion when the second jaw is moved into its operative position.

18. A mounting section as claimed in claim 17 wherein the snap fit connection comprises cooperating male and female formations, at least one of the said male and female formations being resilient to enable the snap fit connection thereof and to enable selective release of the snap fit connection.

19. A mounting section as claimed in claim 18 wherein the retaining member is connected to the second jaw at a hinge which enables the retaining member to be moved with a hinging movement about that hinge during assembly of the edge of the panel with the mounting section.

20. A mounting section as claimed in claim 19 wherein the retaining member is formed integrally with said second jaw and said hinge is defined by a flexible connecting portion between the retaining member and the second jaw.

21. A mounting section as claimed in claim 13 wherein the second jaw comprises a wall having an outer edge defining together with the first jaw the mouth of the channel portion having an inner edge, the hinged mounting of the second jaw being located along the inner edge of the wall where the wall is mounted to the base portion.

22. A mounting section as claimed in claim 21 wherein the wall extends downwardly from the mouth to join the base portion and the retaining member extends from the mouth directly towards the base portion so that the base portion, retaining member and wall together define a triangular configuration in side sectional view.

23. A mounting section as claimed in claim 22 wherein the retaining member connects to the base portion by a hinge connection, the retaining member connects to the wall by a hinge connection, and the wall connects to the base portion by a snap fit connection after the panel is located in its generally desired final position and extends through the mouth.

24. A mounting section as claimed in claim 13 and further including a key formation enabling securing of the base portion to the structure by securing means which cooperates with the key formation and with the structure to secure the base portion to the structure.

25. A mounting section as claimed in claim 24 wherein the key formation comprises a plurality of projections and concave formations provided on the base portion and facing generally towards the structure, the securing means comprising a hardenable adhesive which is located between the mounting section and the structure and which in use conforms to the shape of the projections and concave formations and which adheres to the structure so that when the adhesive has hardened it secures the mounting section to the structure.

26. A mounting section for operative engagement with an edge of a panel, the mounting section being securable to a structure to thereby enable mounting of the panel edge to the structure, the mounting section including a base portion for securing to the structure and a channel portion for receiving the panel edge, the channel portion having a mouth racing away from the base portion and through which the panel extends in use, the channel portion including a first jaw defining one side of the mouth and an opposed second jaw defining the opposite side of the mouth, both the first and second jaws being mounted to the base portion when the panel edge is located in the channel portion and is mounted by the mounting section to the structure, the second jaw being mounted to the base portion by a hinged mounting enabling hinging movement of the second jaw relative to the base during or subsequent to the location of the panel edge within the mouth of the channel portion, the mounting section further including retaining means operable between the second jaw and the base portion so as to retain the second jaw against hinging movement following location of the panel edge within the mouth of the channel portion.

* * * * *

UNITED STATES PATENT AND TRADEMARK OFFICE

CERTIFICATE OF CORRECTION

PATENT NO. : 5,377,463

DATED : January 3, 1995

INVENTOR(S) : Ian Thomas Howe

It is certified that error appears in the above-indentified patent and that said Letters Patent is hereby corrected as shown below:

On the title page, insert as item [63], after the filing date--continuation in part of PCT/AU91/00491 filed 25th October, 1991--.

Signed and Sealed this

Thirtieth Day of January, 1996

*Attest:*

*Attesting Officer*

BRUCE LEHMAN

*Commissioner of Patents and Trademarks*